US006731306B2

(12) United States Patent
Booth, Jr. et al.

(10) Patent No.: US 6,731,306 B2
(45) Date of Patent: May 4, 2004

(54) DISPLAY PANEL

(75) Inventors: Lawrence A. Booth, Jr., Phoenix, AZ (US); Kannan Raj, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 67 days.

(21) Appl. No.: 09/974,168

(22) Filed: Oct. 9, 2001

(65) Prior Publication Data

US 2002/0024515 A1 Feb. 28, 2002

Related U.S. Application Data

(62) Division of application No. 09/352,726, filed on Jul. 13, 1999.

(51) Int. Cl.[7] ..... G09G 5/10
(52) U.S. Cl. ..... 345/690; 89/90; 89/98
(58) Field of Search ..... 345/89, 90, 98, 345/690, 204–206; 365/185.25

(56) References Cited

U.S. PATENT DOCUMENTS 5,111,195 A * 5/1992 Fukuoka et al. ..... 345/204
5,241,656 A * 8/1993 Loucks et al. ..... 345/545
5,694,141 A * 12/1997 Chee ..... 345/1.1
5,952,991 A * 9/1999 Akiyama ..... 345/98
5,959,598 A * 9/1999 McKnight ..... 345/90
5,977,940 A * 11/1999 Akiyama et al. ..... 345/205
6,005,558 A * 12/1999 Hudson et al. ..... 345/204
6,100,909 A * 8/2000 Haas et al. ..... 347/141
6,177,915 B1 * 1/2001 Beeteson et al. ..... 345/87
6,204,864 B1 * 3/2001 Chee ..... 345/531
6,246,386 B1 * 6/2001 Perner ..... 345/90
6,278,428 B1 * 8/2001 Smith et al. ..... 345/92
6,476,784 B2 * 11/2002 Zavracky et al. ..... 345/88

* cited by examiner

*Primary Examiner*—Bipin Shalwala
*Assistant Examiner*—Ricardo Osorio
(74) *Attorney, Agent, or Firm*—Trop, Pruner & Hu, P.C.

(57) ABSTRACT

A method includes storing an analog indication of a terminal voltage of a pixel cell. A second indication of an incremental update to the terminal voltage is received, and the analog indication is used to modify the terminal voltage to reflect the incremental update. The pixel cell may form part of a display panel.

9 Claims, 5 Drawing Sheets

DISPLAY PANEL

This is a divisional of prior application Ser. No. 09/352,726 filed on Jul. 13, 1999.

BACKGROUND

The invention generally relates to an optical display device, and more particularly, the invention relates to a display panel, such as an active matrix liquid crystal display (LCD) panel, for example.

Referring to FIG. 1, a typical portable computer system 30 (a laptop or hand-held computer system, as examples) may include a liquid crystal display (LCD) panel 36 to generate images for the computer system 30. In this manner, a processor 32 (a central processing unit (CPU), for example) may store image data (in a system memory 34) that indicates intensity values for an image to be displayed on the LCD panel 36. The image data may be temporarily stored in a frame buffer 31.

Referring to FIG. 2, as an example, the display panel 36 may be an active matrix liquid crystal display (LCD) panel that includes an array 6 of pixel cells 25 (arranged in rows and columns) that form corresponding pixels of an image. To accomplish this, each pixel cell 25 typically receives an electrical voltage that controls optical properties of the cell 25 and thus, controls the perceived intensity of the corresponding pixel. If the cell 25 is a reflective pixel cell, the level of the voltage controls the amount of light that is reflected by the cell 25, and if the cell 25 is a transmissive pixel cell, the level of the voltage controls the amount of light that is transmitted by the cell 25.

Updates are continually made to the voltages of the pixel cells 25 to refresh or update the displayed image. More particularly, each pixel cell 25 may be part of a different display element 20 (a display element 20*a*, for example), a circuit that stores a charge that indicates the voltage for the pixel cell. The charges that are stored by the display elements 20 typically are updated (via row 4 and column 3 decoders) in a procedure called a raster scan. The raster scan is sequential in nature, a designation that implies the display elements 20 are updated in a particular order such as from left-to-right or from right-to-left.

As an example, a particular raster scan may include a left-to-right and top-to-bottom "zig-zag" scan of the array 8. More particularly, the display elements 20 may be updated one at a time, beginning with the display element 20*a* that is located closest to the upper left corner of the array 6 (assuming the display panel 1 is standing upright). During the raster scan, the display elements 20 are individually and sequentially selected (for charge storage) in a left-to-right direction across each row, and the updated charge is stored in each display element 20 when the display element 20 is selected. After each row is scanned, the raster scan advances to the leftmost display element 20 in the next row immediately below the previously scanned row.

During the raster scan, the selection of a particular display element 20 may include activating a particular row line 14 and a particular column line 16, as the rows of the display elements 20 are associated with row lines 14 (row line 14*a*, as an example), and the columns of the display elements 20 are associated with column lines 16 (column line 16*a*, as an example). Thus, each selected row line 14 and column line 16 pair uniquely addresses, or selects, a display element 20 for purposes of transferring a charge (in the form of a voltage) from a video signal input line 12 to a capacitor 24 (that stores the charge) of the selected display element 20.

As an example, for the display element 20*a* that is located at pixel position (0, 0) (in cartesian coordinates), a voltage may be applied to the video signal input line 12 (at the appropriate time) that indicates a new charge that is to be stored in the display element 20*a*. To transfer this voltage to the display element 20*a*, the row decoder 4 may assert (drive high, for example) a row select signal (called $ROW_0$) on a row line 14*a* that is associated with the display element 20*a*, and the column decoder 3 may assert a column select signal (called $COL_0$) on column line 16*a* that is also associated with the display element 20*a*. In this manner, the assertion of the $ROW_0$ signal may cause a transistor 22 (of the display element 20*a*) to couple a capacitor 24 (of the display element 20*a*) to the column line 16*a*. The assertion of the $COL_0$ signal may cause a transistor 18 to couple the video signal input line 12 to the column line 16*a*. As a result of these connections, the charge that is indicated by the voltage of the video signal input line 12 is transferred to the capacitor 24 of the display element 20*a*. The other display elements 20 may be selected for charge updates in a similar manner.

FIG. 3 illustrates the optical response of the pixel cell 25 to its terminal voltage for the case where the pixel cell is a twisted nematic, transmissive pixel cell and backlighting is used. As shown, when the voltage surpasses a range 37 of voltages, the pixel cell 25 permits the maximum amount (fifty percent, for example) of light to pass through the cell 25, a state in which the pixel cell 25 is fully turned on (i.e., the intensity of the light that is emitted by the pixel cell 25 is maximized). Likewise, when the voltage is between zero volts and the range 37, the pixel cell 25 substantially blocks the light from passing through and is placed in a fully turned off state. The transmission characteristics of the pixel cell 25 may be symmetrical, i.e., the same effects may be produced if the polarity of the terminal voltage is reversed, as depicted in FIG. 3.

For the range 37 of voltages, the pixel cell 25 is neither turned on or off, but rather, the pixel cell exhibits different intensities between the fully turned on intensity and the fully turned off intensity. Typically, the voltage of the pixel cell 25 remains within the range 37 to cause a desired shade of gray (for a black and white display panel) or a desired shade of color (for a color display panel in which the pixel cell 25 is covered by a color filter). As an example, quite often the voltages in the range 37 are associated with a range of discrete pixel intensities from 0 to 255, called grayscale values. Therefore, the intensity of the pixel cell 25 may have a dynamic range, of two hundred fifty-six different discrete intensity levels. Unfortunately, a large number (eight, for example) of bits may be used to communicate each intensity value from the frame buffer 31 to the display panel 36. As a result, the bandwidth of communication between the display panel and the rest of the computer system 30 may be limited.

Thus, there is a continuing need for an arrangement that addresses one or more of the above-stated problems.

SUMMARY

In one embodiment of the invention, a method includes storing an analog indication of a terminal voltage of a pixel cell. A second indication of an incremental update to the terminal voltage is received, and the analog indication is used to modify the terminal voltage to reflect the incremental update.

In another embodiment, a method includes storing analog indications of terminal voltages of pixel cells and using the analog indications to refresh the terminal voltages.

DETAILED DESCRIPTION

Figure 1:
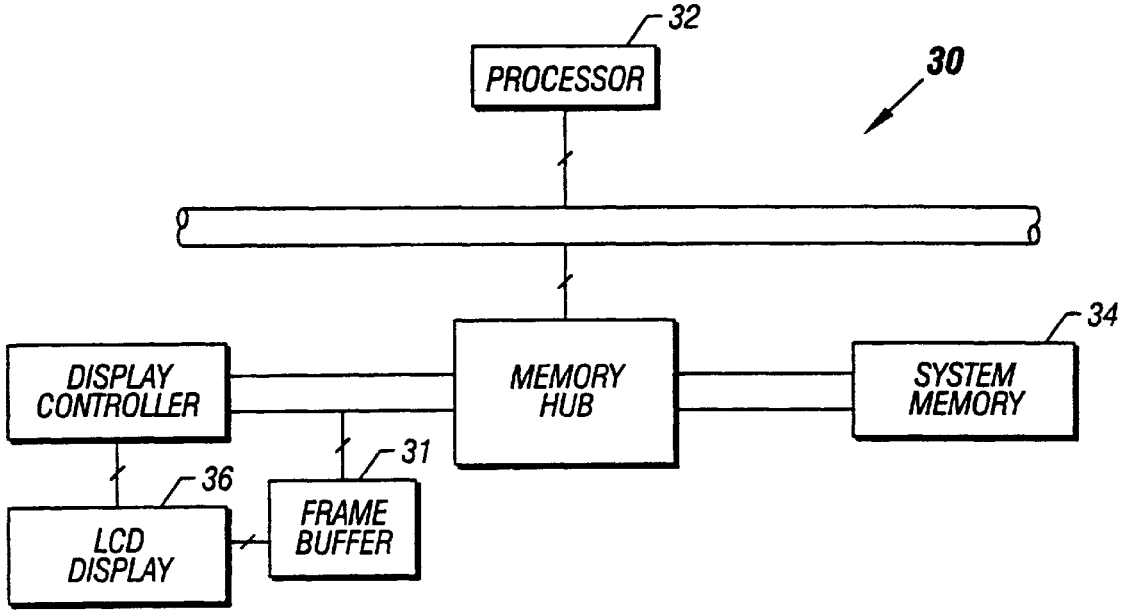
FIG. 1 (PRIOR ART)
FIG. 1 is a schematic diagram of a computer system according to the prior art.
Figure 3:
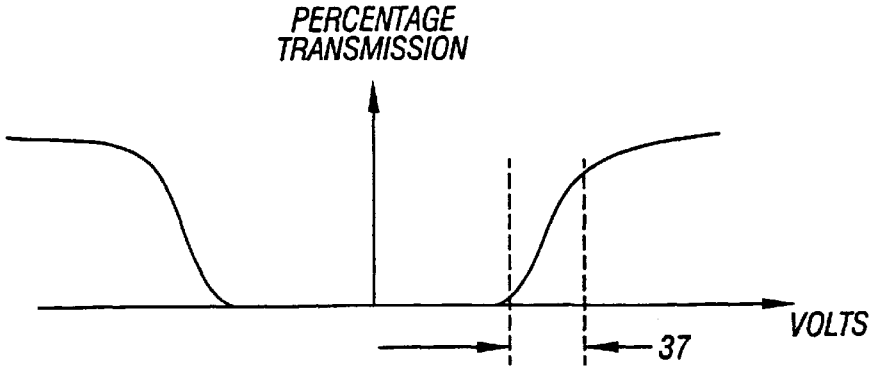
FIG. 3 (PRIOR ART)
FIG. 3 is a transmission versus terminal voltage characteristic of a liquid crystal pixel cell according to the prior art.
Figure 2:
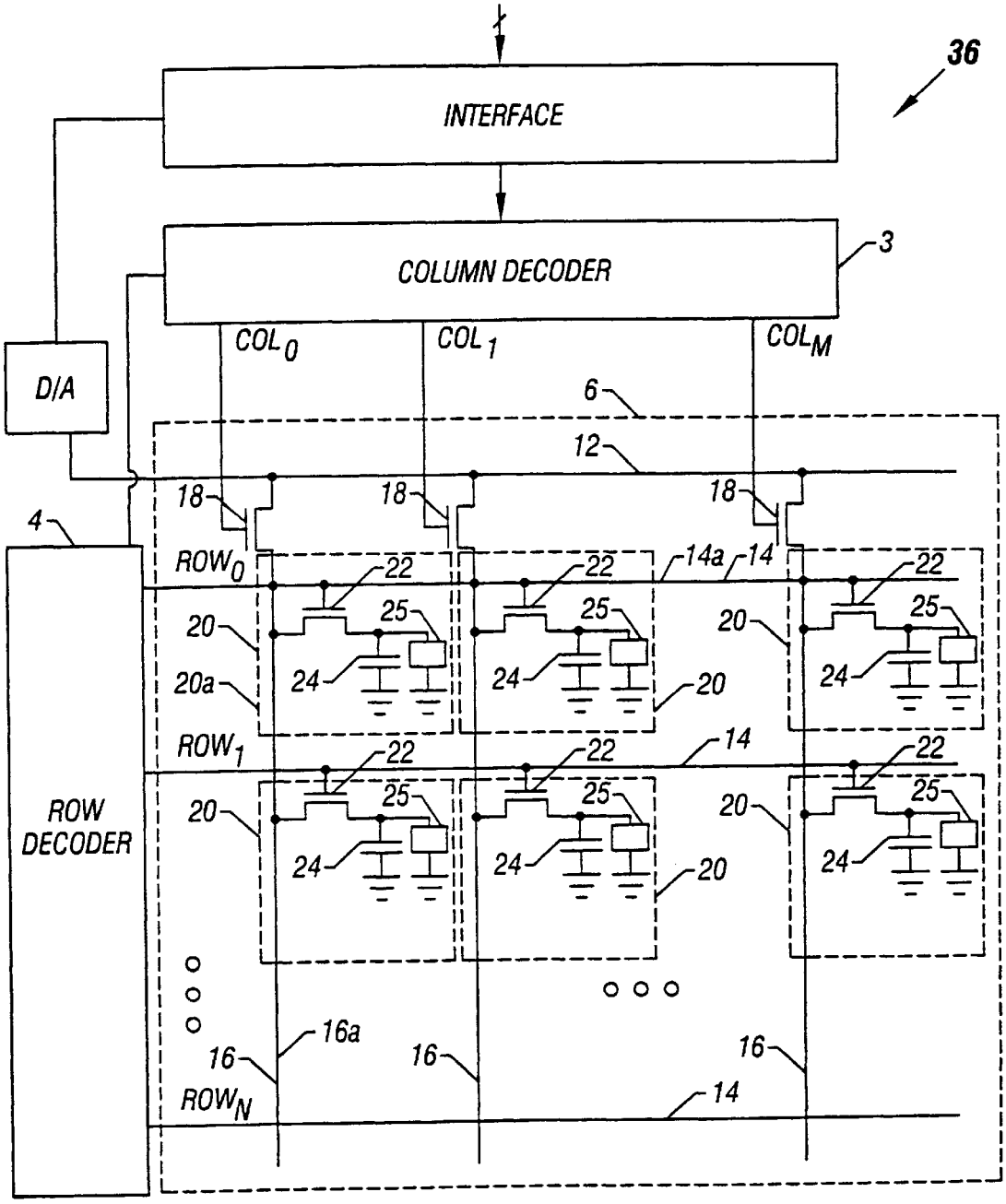
FIG. 2 (PRIOR ART)
FIG. 2 is a schematic diagram of a display panel according to the prior art.
Figure 4:
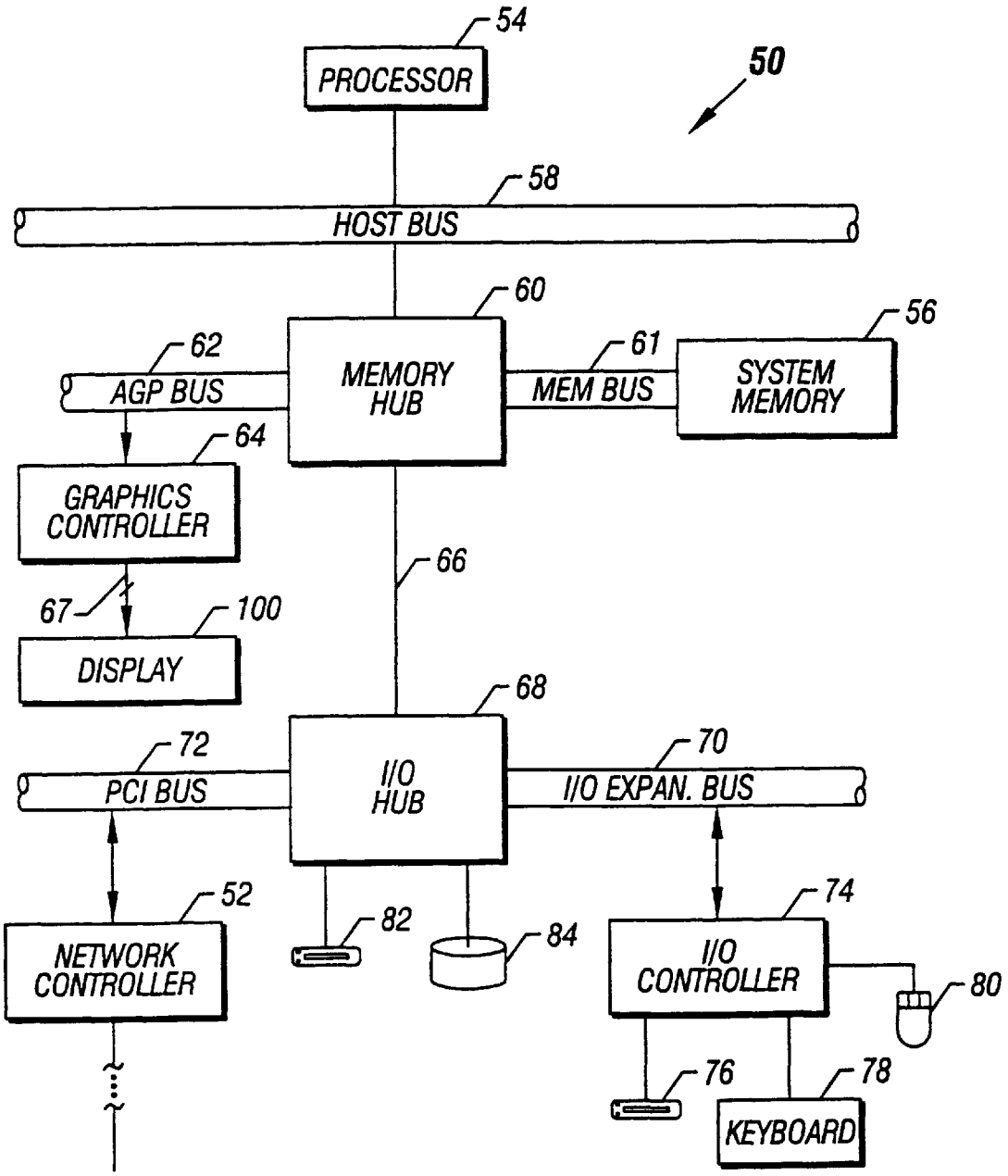
FIG. 4 is a schematic diagram of a computer system according to an embodiment of the invention.

Referring to FIG. 4, a computer system 50 in accordance with the invention includes a liquid crystal display (LCD) panel 100. Instead of furnishing indications of absolute intensity levels to the display panel 100, the computer system 50 furnishes indications of incremental intensity changes, or deltas, to the display panel 100. For example, to change an intensity level of a particular pixel cell from an intensity level of two hundred to an intensity level of two hundred ten, the display panel 100 may receive a digital value that indicates a ten (not two hundred ten) for the intensity value of the pixel cell. As a result of this technique, a higher dynamic range may be achieved, image processing time may be increased and fewer bits may be used to communicate the incremental intensities to the display panel 100.

Figure 5:
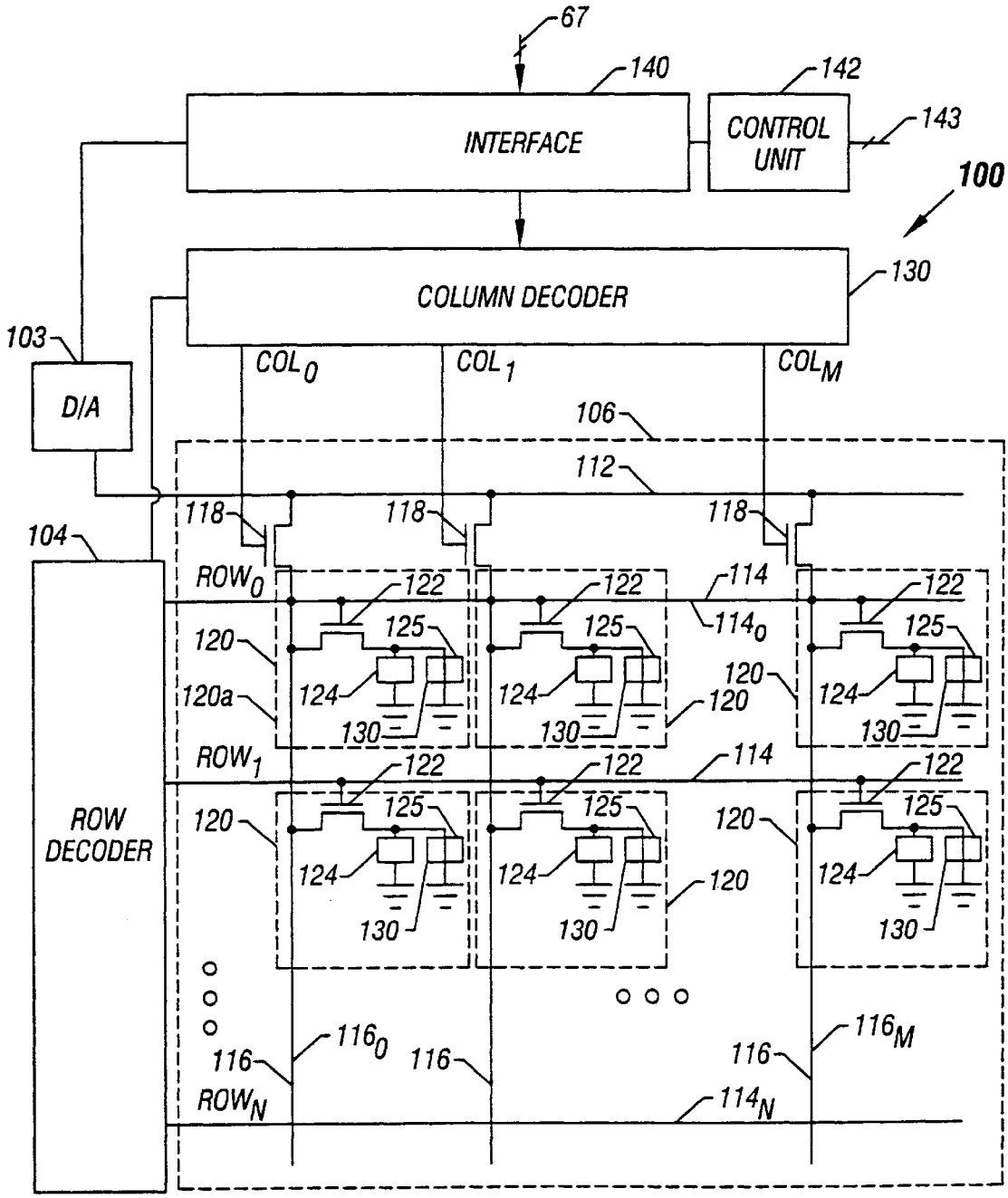
FIG. 5 is a schematic diagram of a display panel according to an embodiment of the invention.

Referring to FIG. 5, more particularly, the display panel 100 may include an array 106 of pixel cells 125 (liquid crystal display (LCD) pixel cells, for example) that may be arranged in rows and columns. Each pixel cell 125, in turn, may be part of a display element 120, a circuit that stores a charge that indicates an intensity of a pixel (of an image) that is formed by the pixel cell 125. The rows of pixel cells 125 may be associated with row lines 114 (lines $\mathbf{114}_0$, $\mathbf{114}_1$, . . . $\mathbf{114}_N$, as examples), and the columns of pixel cells 125 may be associated with column lines 116 (lines $\mathbf{116}_0$, $\mathbf{116}_1$, . . . $\mathbf{116}_M$, as examples). The selection of a particular row line 114 and a particular column line 116 uniquely addresses one of the display elements 120 to update the charge that is stored by the display element 120. Each column line 116 is selected via an associated column select transistor 118, and each row line 116 is selected via an associated row select transistor 122.

In some embodiments, each liquid crystal cell 125 is associated with a different update circuit 130, a circuit that may be used to incrementally update the pixel intensity of the cell 125. In this manner, when the row 122 and column 118 select transistors select a particular pixel cell 125, the circuit 130 may be used to update the cell's terminal voltage (that indicates the cell's currently emitted light intensity) with an incremental voltage (that may indicate a positive or negative change in the currently emitted light intensity). Thus, in effect, the update circuit 130 receives an indication of a desired incremental change in the cell's intensity and changes the cell's intensity to reflect the desired incremental change.

As a result of this technique, indications of intensity differences (instead of absolute intensities) may be communicated to the display panel. Because, in general, temporal redundancy exists in the image of a particular scene, the intensity level of a particular pixel cell may change by a relatively small amount (as compared to its absolute value) between frames of the scene. This temporal redundancy is exploited by using less bits to communicate the desired pixel intensities. For example, the intensity of light that is emitted by a particular pixel cell may have approximately one of two hundred fifty-five different discrete levels and thus, may be represented by eight bits. For the currently displayed frame, the intensity may have an absolute value of fifty. However, for the next frame, the intensity level may increase from two hundred ten to two hundred fifteen. Thus, as few as three bits may be used to communicate the increase in intensity, instead of the eight bits that conventional circuitry uses to communicate the absolute intensity.

In some embodiments, a predetermined number (three or four, as examples) of bits are allocated per pixel cell to indicate the incremental intensity update for the cell. If the desired incremental change is beyond the maximum change that may be indicated by the bits, then the intensity may be updated over more than one frame. In some embodiments, for the very first frame, the pixel cells 125 are initialized to the same predetermined intensity level, such as an intensity level of one hundred twenty-eight, for example. This technique may be used, for example, in embodiments where the display panel 100 updates the pixel cells 125 at a faster rate than the rate at which the data is received by the display panel 100. In this manner, a low bit rate digital-to-analog (D/A) converter 103 (a one bit D/A converter, for example) may be used to furnish the analog signals to the pixel cells 125, and as a result, gain nonlinearities in the D/A conversion process may be substantially reduced.

The initialization of a pixel cell's intensity to an absolute intensity level is accomplished through an absolute intensity mode of the associated update circuit 130. Thereafter, the update circuit 130 may be placed in an incremental intensity mode to perform the incremental updates, as described below.

Figure 6:
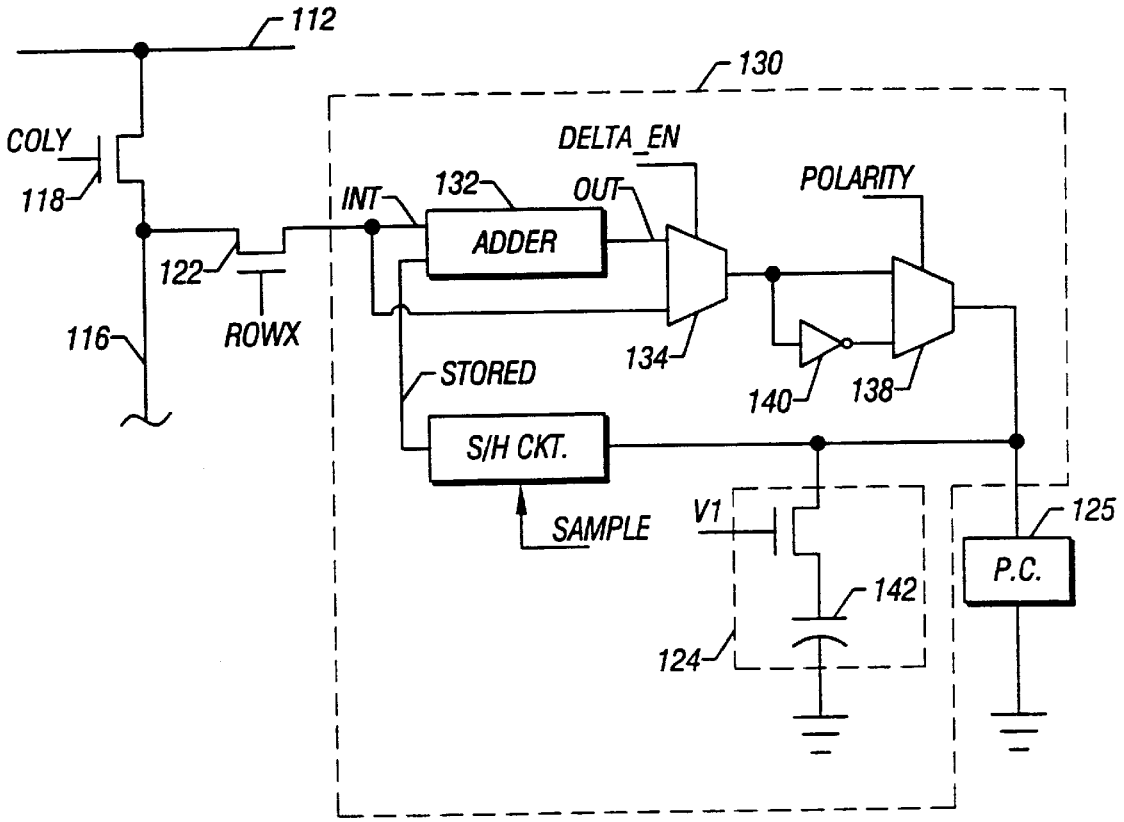
FIG. 6 is a schematic diagram of an update circuit of the display panel of FIG. 5 according to an embodiment of the invention.

FIG. 6 depicts an embodiment of the update circuit 130. As shown, the update circuit 130 includes an adder 132 that receives a signal called INT that may indicate either an absolute intensity (for the absolute intensity mode) or an incremental intensity (for the incremental intensity mode). When the associated row 122 and column 118 select transistors are activated to select the pixel cell 125 that is associated with the update circuit 130, the INT signal indicates a pixel intensity for the next frame. In this manner, when the update circuit 130 is in the incremental intensity mode and the update circuit 130 is selected, the INT signal indicates the incremental intensity. When the update circuit 130 is in the absolute intensity mode and the update circuit 130 is selected, the INT signal indicates the absolute intensity.

For the incremental intensity mode, the adder 132 adds the incremental intensity (indicated by the INT signal) with a stored intensity (indicated by a signal called STORED) to produce a signal called OUT that indicates the pixel intensity for the next frame and is routed to the pixel cell 125, as described below. The STORED signal is provided by a sample and hold circuit 136 that is coupled to the pixel cell 125. In this manner, before an update occurs, a signal (called SAMPLE) is momentarily asserted (driven high, for example) to cause the sample and hold circuit 136 to sample and store the terminal voltage of the pixel cell 125.

The pixel cell 125 typically has a small associated capacitor (not shown) to maintain the terminal voltage of the pixel cell and thus, maintain the desired intensity. However, this small capacitor typically has a small leakage current, a current that removes charge from the capacitor and reduces the terminal voltage across the pixel cell 125 between updates. For incremental updates, the light intensity emitted by the pixel cell 125 may decay over time, as the incremental updates assume no charge leakage.

For purposes of preventing this decay in intensity due to charge leakage, in some embodiments, the update circuit 130 includes a storage unit 124 that stores the terminal voltage across the associated pixel cell 125 after each update. In some embodiments, unlike the pixel cell 125, the storage unit 124 may have features that minimize the amount of leakage. For example, the storage unit 124 may include a capacitor 142 that has a much larger capacitance than the capacitor of the pixel cell 125. As another example, the storage unit 124 may alternatively include a latch (not shown) that replaces the capacitor 142.

In some embodiments, the display panel 100 may use the storage units 124 to regularly refresh the pixel cells 125 automatically without receiving new image data. Thus, in this manner, image data may be communicated to the display panel 100 only once to produce a still image. Afterwards, the display panel 100 may, for example, periodically update the pixel cells 125 so that the displayed image does not fade. To accomplish this, in some embodiments, a control unit 142 (see FIG. 5) of the display panel 100 periodically places the update circuits 130 in the incremental intensity mode and interacts with a column decoder 130 and a row decoder 104 to select all update circuits 130. The control unit 142 also interacts with the D/A converter 103 to set the INT signal (received by all of the update circuits 130) to approximately zero to cause each update circuit 130 to refresh its associated pixel cell 125 with the voltage that is stored in the associated storage unit 124.

In some embodiments, each storage unit 124 may include a transistor (an n-channel metal-oxide-semiconductor (nMOS) transistor, for example) that is activated (via a signal called V1) to couple the capacitor 142 to the pixel cell 125 to refresh the terminal voltage across the pixel cell 125 before an incremental update occurs. The transistor 144 remains activated during the update to capture the new terminal voltage across the pixel cell 125. After the update, the transistor 144 is deactivated, an event that isolates the capacitor 124 from the pixel cell 125.

Among the other features of the update circuit 130, the update circuit 130 may include a multiplexer 134 that receives the INT and OUT signals. The multiplexer 134 selects between the INT (for the absolute intensity mode) and OUT (for the incremental intensity mode) signals based on the state of a mode select signal called DELTA_EN. In some embodiments, the output terminal of the multiplexer 134 may be directly coupled to the pixel cell 125. However, in other embodiments, the output terminal of the multiplexer 134 is coupled to circuitry that alternates the polarity of the terminal voltage of the pixel cell 125 to prevent ionic degradation of the pixel cell 125. Ionic degradation increases with the magnitude of the net DC voltage that exists across the pixel cell 125 over time. To reduce the net DC voltage, the output terminal of the multiplexer 134 may be coupled to an input terminal of a multiplexer 138. An inverter 140 is coupled between the output terminal of the multiplexer 134 and another input terminal of the multiplexer 138, and the output terminal of the multiplexer 138 is coupled to the pixel cell 125. In this manner, a signal (called POLARITY) approximately alternates the polarity of the terminal voltage for each new frame, i.e., for each new update. Because the intensity generated by the pixel cell 125 is a function of the absolute voltage across the pixel cell 125, the polarity changes do not affect the optical output of the pixel cell 125.

Referring back to FIG. 5, among the other features of the display panel 100, a bus interface 140 may receive digital indications of the incremental and/or absolute intensities from lines 67 that are coupled to a graphics controller 65. A column decoder 130 selectively activates the appropriate column select transistors 118, and a row decoder 104 selectively activates the appropriate row select transistors 122. A digital-to-analog (D/A) converter 103 converts the digital indications of the intensities into an analog voltage on an input line 106. In this manner, the voltage of the input line 106 indicates the intensities for the different pixel cells 125 in a time multiplexed fashion, and the column decoder 130 selectively activates the column select transistors 118 during the appropriate time slots. The display panel 100 may also include a control unit 142 that furnishes signals (the POLARITY and DELTA_EN signals, as examples) via control lines 143 to coordinate the above-described activities of the display panel 100.

Figure 7:
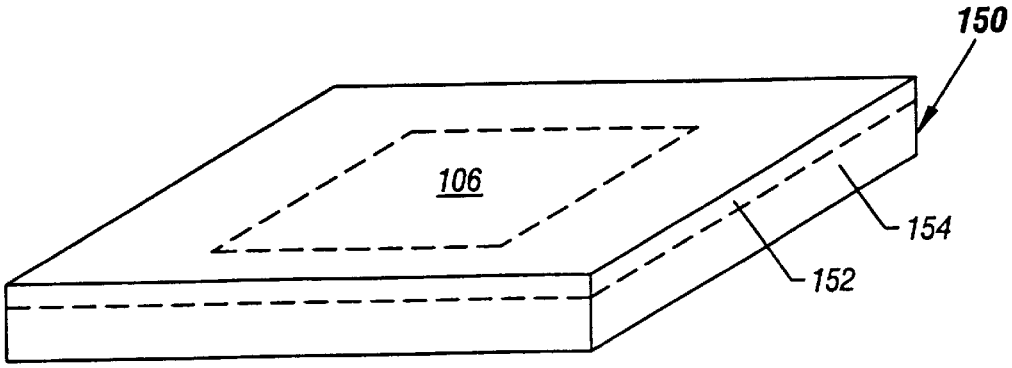
FIG. 7 is a schematic diagram of a semiconductor die on which circuitry of the display panel is fabricated.

Referring to FIG. 7, in some embodiments, the display panel 100 may be fabricated on a semiconductor die 150. In this manner, the array 106 may be fabricated in a generally upper planar region 152 of the die 150 with the other circuitry, such as the update circuits 130, for example, being fabricated in a generally lower planar region 154 that may be located beneath the upper planar region 152.

Referring back to FIG. 4, among the other features of the computer system 50, the computer system 50 may also include a processor 54 that is coupled to a host bus 58. In this context, the term "processor" may generally refer to one or more central processing units (CPUs), microcontrollers or microprocessors (an X86 microprocessor, a Pentium® microprocessor or an Advanced RISC Machine (ARM)® microprocessor, as examples), as just a few examples. Furthermore, the phrase "computer system" may refer to any type of processor-based system that may include a desktop computer, a laptop computer, an appliance, a digital camera or a set-top box, as just a few examples. Thus, the invention is not intended to be limited to the illustrated computer system 50, but rather, the computer system 50 is an example of one of many possible embodiments of the invention.

The host bus 58 may be coupled by a bridge, or memory hub 60, to an Accelerated Graphics Port (AGP) bus 62. The AGP is described in detail in the Accelerated Graphics Port Interface Specification, Revision 1.0, published in Jul. 31, 1996, by Intel Corporation of Santa Clara, Calif. The AGP bus 62 may be coupled to, for example, a video controller 64 that controls a display 65. The memory hub 60 may also couple the AGP bus 62 and the host bus 58 to a memory bus 61. The memory bus 61, in turn, may be coupled to a system memory 56 that may, as examples, store the buffers 304 and a copy of the driver program 57.

The memory hub 60 may also be coupled (via a hub link 66) to another bridge, or input/output (I/O) hub 68, that is coupled to an I/O expansion bus 70 and a bus 72. The bus 72 may be coupled to a network controller 52, for example. The I/O hub 68 may also be coupled to, as examples, a CD-ROM drive 82 and a hard disk drive 84. The I/O expansion bus 70 may be coupled to an I/O controller 74 that controls operation of a floppy disk drive 76 and receives input data from a keyboard 78 and a mouse 80, as examples. As an example, the bus 72 may be a Peripheral Component Interconnect (PCI) bus. The PCI Specification is available from The PCI Special Interest Group, Portland, Oreg. 97214.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A method comprising:

storing charges in a first set of capacitors to update terminal voltages of pixel cells;

storing analog indications of the terminal voltages in a second set of capacitors concurrently with the updating, the second set of capacitors being separate from the first set of capacitors; and subsequently using the stored analog indications to refresh the terminal voltage, wherein each pixel cell is associated with one of the first capacitors and one of the second capacitors.

2. The method of claim 1, wherein the act of using comprises:

refreshing the terminal voltages at regular intervals.

3. The method of claim 1, wherein the act of using comprises:

refreshing the terminal voltages without communicating data that indicates pixel intensities.

4. The method of claim 1, wherein each of the second set of capacitors has a substantially larger capacitance than a capacitance of any of the first set of capacitors.

5. A display panel comprising:

first capacitors;

second capacitors separate from the first capacitors;

pixel cells, each pixel cell being associated with one of the first capacitors and one of the second capacitors; and update circuits, each update circuit to:

store a first analog indication of a terminal voltage of one of the pixel cells in the first capacitor associated with the pixel cell and concurrently store a second analog indication of the terminal voltage in the second capacitor associated with the pixel cell, and subsequently use the second stored analog indication to refresh the terminal voltage of the associated pixel cell.

6. The display panel of claim 5, wherein each of the second set of capacitors has a substantially larger capacitance than a capacitance of any of the first set of capacitors.

7. The display panel of claim 5, wherein each first capacitor is connected to at least one terminal of the associated pixel cell.

8. The display panel of claim 5, wherein each update circuit is further adapted to refresh the terminal voltage of the associated pixel cell at regular intervals.

9. The display panel of claim 5, wherein each update circuit is further adapted to refresh the terminal voltage of the associated pixel cell without communicating data that indicates pixel intensities.

* * * * *